United States Patent [19]

Guthrie

[11] 4,429,350

[45] Jan. 31, 1984

[54] UNDERWATER ILLUMINATION DEVICE

[76] Inventor: Gaylord N. Guthrie, 2812 Rose, Pasadena, Tex. 77503

[21] Appl. No.: 418,230

[22] Filed: Sep. 15, 1982

[51] Int. Cl.[3] ..... B25B 23/18

[52] U.S. Cl. ..... 362/120; 362/109; 362/158; 362/190; 362/191; 362/186; 362/267; 362/310; 362/399; 362/418; 362/431; 362/450

[58] Field of Search ..... 362/158, 399, 449, 450, 362/418, 431, 267, 109, 120, 190, 191, 186, 310

[56] References Cited

U.S. PATENT DOCUMENTS

| | | | |
|---|---|---|---|
| 895,355 | 8/1908 | Farr . | |
| 2,089,611 | 8/1937 | Koerber | 362/399 |
| 3,464,139 | 9/1969 | Eggers . | |
| 3,502,861 | 3/1970 | Evans . | |
| 3,525,765 | 1/1970 | Rossi . | |
| 3,617,733 | 11/1971 | Adams . | |
| 3,652,846 | 3/1972 | Stark . | |
| 3,743,380 | 7/1973 | Fugitt . | |
| 3,748,457 | 7/1973 | Balitzky et al. | 362/158 |
| 3,794,825 | 2/1974 | Krupansky . | |
| 3,978,330 | 8/1976 | Maurer . | |
| 4,053,758 | 10/1977 | Shaw | 362/158 |
| 4,114,187 | 9/1978 | Uke . | |
| 4,187,533 | 2/1980 | Hampton | 362/158 |
| 4,300,186 | 11/1981 | Hurd | 362/66 |

FOREIGN PATENT DOCUMENTS

| | | | |
|---|---|---|---|
| 1116103 | 10/1961 | Fed. Rep. of Germany | 362/267 |

*Primary Examiner*—Stephen J. Lechert, Jr.
*Assistant Examiner*—Howard J. Locker
*Attorney, Agent, or Firm*—Browning, Bushman, Zamecki & Anderson

[57] ABSTRACT

A subsurface light comprising an illumination source and an elongate handle attached to and extending from the illumination source. The length of the handle is adjustable. The light further includes a buoyant body having generally planar inboard and outboard services connected to the handle inboard of the illumination source. At least one plate secured to the buoyant body is mounted to the handle by an integral flap.

13 Claims, 3 Drawing Figures

UNDERWATER ILLUMINATION DEVICE

BACKGROUND OF THE INVENTION

1. Field of the Invention

The present invention pertains to light sources used for underwater observation. More particularly, the present invention pertains to light sources that direct light toward the water's bottom while floating along the surface of the water, and finds particular application in floundering.

2. Description of the Prior Art

It is a practice along coastal waters to flounder at night in the shallow water a short distance from the water's edge. The flounder generally lie flat on the sandy bottom in shallow water. When a flounder is seen along the floor of the water, the fisherman stabs the flounder with a spear commonly referred to as a "gig." It is well known for fisherman to carry flashlights or lanterns of one type or another for illuminating the water's bottom. To maximize such illumination while overcoming the effects of light reflections from the water's surface, the fisherman may be required to walk in a stooped position and hold the light as close to the water's surface as possible. However, the surface reflections remain to interfere with the fisherman's view of the bottom.

Several underwater light sources are known which may avoid surface reflections. However, these devices do not offer the features or advantages of the present invention in relation to the requirements for floundering.

U.S. Pat. No. 895,355 discloses a search light mounted on a stem for submarine observation, and including an array of lights mounted within a fluid-tight chamber between a concave reflecting surface and a curved glass cover. The fluid-tight chamber, as well as air entrapped within the concave curvature of the glass, provides a certain amount of buoyancy in water.

U.S. Pat. No. 3,464,139 shows a float with a light source held above the surface of the water. A similar arrangement is shown in U.S. Pat. No. 3,617,733 but with a portion of the light extending outwardly from a floating housing for disposition in the water.

U.S. Pat. Nos. 3,502,861; 3,526,765; 3,652,846; 3,743,380; 3,794,825; 3,978,330 and 4,114,187 disclose various hand-held fluid-tight light sources, some particularly intended for use submerged under water.

These prior light sources are not especially adapted to the particular needs of the flounder fisherman. For this purpose, it is desirable to provide a light source that may be maintained submerged below the water's surface, directed toward the bottom of the body of water, and operable from easily available power sources. Further, it is desirable to mount the light on an extendable handle. It is likewise desirable to provide a simpler, more convenient, and more effective way of constructing such a device.

SUMMARY OF THE INVENTION

The present invention provides a subsurface lighting apparatus comprising an illumination means and an elongate handle attached to and extending from the illumination means. The handle includes means for selectively adjusting its length. A buoyant body of substantially uniform thickness and having generally planar inboard and outboard surfaces is connected to the handle inboard of the illumination means.

In preferred embodiments, the buoyant body is disposed at a non-perpendicular angle with respect to the handle and a reflector plate is secured against the outboard surface of the buoyant body. The angular position of the buoyant body permits it to float upon the water with the handle disposed at a convenient angle for the user, and with the illumination means submerged in the water so as to better illuminate the bottom. The reflector plate further assists in such illumination. The adjustability of the handle length provides even further convenience for the user as well as adaptability for different users, water depths, etc.

A transparent water-tight cover preferably sealingly surrounds the illumination means, and may be removably attached to the buoyant body, to allow the bulb of the illumination means to be changed. Thus, for example, if the light has been used and then removed from the water, upon reinsertion, the hot bulb will be protected against direct contact with the water to insure against bursting of the bulb. The cover also serves to protect the bulb against breakage without interfering with transmission of light therefrom. Should the bulb, for any reason, break, the cover, which is preferably formed of a suitable plastic, will contain the broken pieces so that they will not be scattered or cause injury.

A particularly convenient technique for assembling the apparatus is to provide a backing plate which is disposed against the inboard surface of the buoyant body. The buoyant body may be clamped between the backing plate and the aforementioned reflector plate by simple means such as screws. Such screws can also serve to attach the water-tight cover to the remainder of the apparatus. At least one, and preferably both of the plates may have an integral flap folded away from the remainder of said plate to form an opening receiving the handle. The flap may be secured to the handle by an annular clamp or the like. This means of assembly is simple and inexpensive, but nevertheless highly effective and readily permits disassembly for maintenance purposes.

It is a principal object of the present invention to provide an improved subsurface lighting apparatus.

Another object of the present invention is to provide such an apparatus which is particularly well adapted for floundering and the like.

Still another object of the present invention is to provide such an apparatus having a handle of selectively variable length.

Still another object of the present invention is to provide such an apparatus embodying an improved flotation means and a particularly convenient way of assembling said apparatus including said flotation means.

Still other objects, features, and advantages of the present invention will be made apparent by the following detailed description, the drawings and the claims.

DETAILED DESCRIPTION

Figure 1:
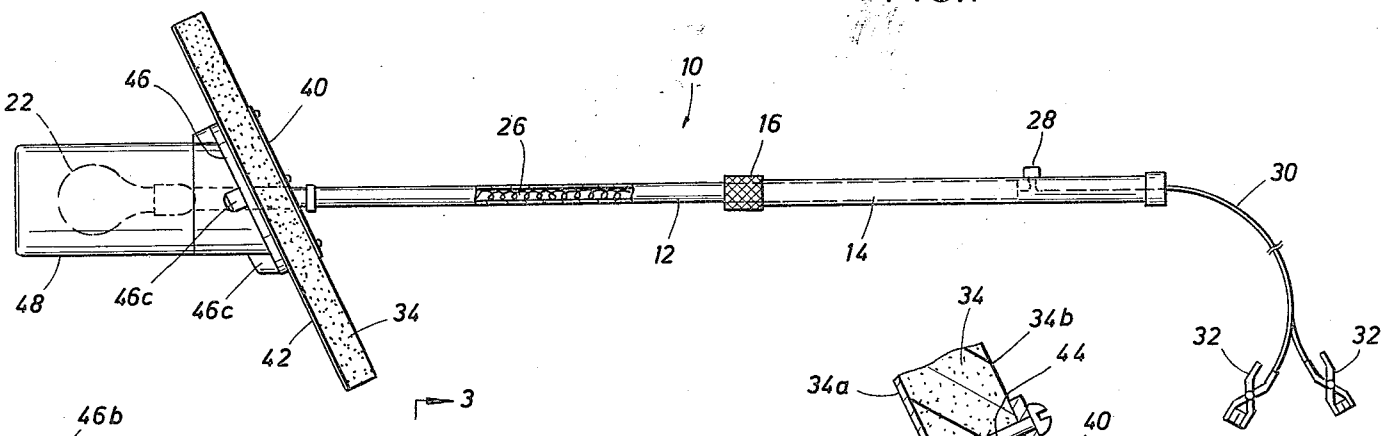
FIG. 1 is a side elevation of an apparatus according to the present invention with part broken away.

The apparatus as shown in FIG. 1 comprises a handle 10 which is adapted to be held in hand by the user, although it could be attached to a boat, dock or other support, especially if used for operations other than floundering. Handle 10 comprises a pair of telescoping tubular sections 12 and 14 joined by an adjusting nut 16 of a type well known in general mechanical arts. By loosening the nut 16, sections 12 and 14 can be telescopically adjusted to the desired handle length for the user, the depth of the water, etc., and then locked in place at that length by retightening the nut 16. Section 14 is intended to be held in the hand of the user and will be referred to herein as the "inboard" portion of handle 10. Section 12 defines the "outboard" end of handle 10.

Figure 2:
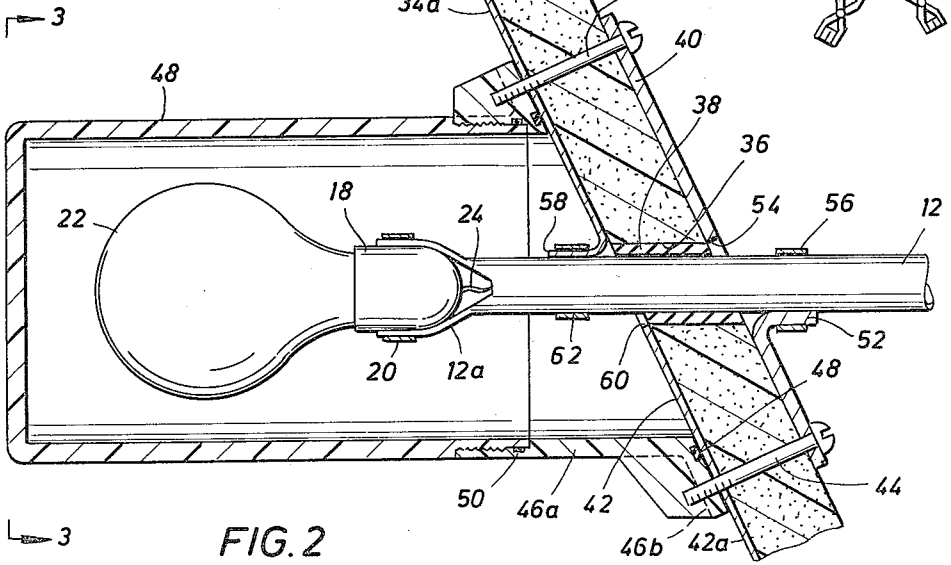
FIG. 2 is an enlarged longitudinal sectional view through the illumination and flotation means and associated parts.
Figure 3:
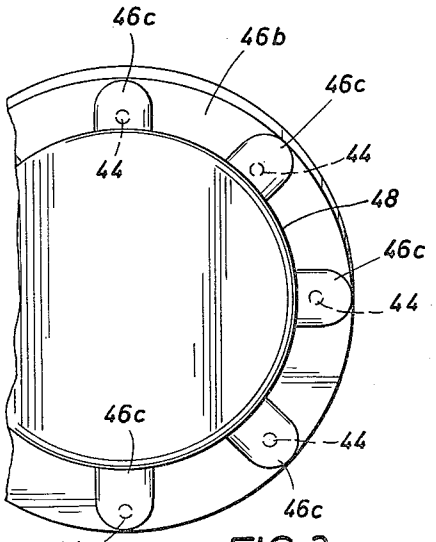
FIG. 3 is a partial elevational view taken along the lines 3—3 in FIG. 2.

Referring now to FIG. 2 in conjunction with FIG. 1, the extreme outboard end of section 12 of handle 10 is bifurcated as indicated at **12*a* to receive a waterproof light socket 18 of a conventional type well known in the art. Socket 18 may be secured in the bifurcated end 12*a* of handle section 12 by any suitable means such as clamps diagrammatically indicated at 20. An illumination source in the form of a light bulb 22 is received in socket 18. The wiring 24 from socket 18 is suitably connected to conductors in a coiled type electrical cord 26 which extends through handle section 12 and through the major portion of handle section 14 to the locus of a push button 28 on the exterior of section 14. The conductors of cord 26 are suitably associated with button 28, as are the conductors of cables 30, so that, by operation of button 28, the conductors of cord 26 may be electrically connected to the conductors of cables 30. Cables 30 terminate in clips 32 which may be attached to the terminals of a battery either carried by the user or a nearby boat or other vehicle or support. The details of the wiring are well within the skill of the art, and will not be further described in detail. The coiled form of cord 26 more readily accommodates extension and retraction of handle 10**.

A flotation means in the form of a slab-like body 34 of buoyant material such as a suitable foam is mounted slightly inboard of light socket 18 on handle section 12. Body 34 has planar outboard and inboard surfaces **34*a* and 34*b* respectively. Body 34 also has a through bore 36 through which handle section 12 extends. An annulus 38 of sealing material is also disposed in bore 36 in surrounding relation to handle section 12 to seal therebetween. The material of sealing annulus 38 may be either a bonding or non-bonding type. Bore 36 is canted so that body 34 and its surfaces 34*a* and 34*b* are disposed at a nonperpendicular angle with respect to handle 12. Thus, when body 34 is floating on the surface of a body of water generally parallel thereto, handle 10** will extend angularly with respect to the surface of the water, rather than in a straight vertical direction, for more convenient handling by the user.

A metallic backing plate 40 is disposed against the inboard surface **34*b* of body 34. Plate 40 need not extend over the full surface area of surface 34*b*. Another metallic plate 42 having a highly reflective outboard surface 42*a* is likewise disposed against outboard surface 34*a* of body 34, but does preferably extend to the outer periphery of surface 34*a*. Body 34 is clamped between plates 40 and 42 by screws 44 which extend through all three members 40, 34 and 42. Screws 44 also serve to connect the assemblage 40, 34, 42 to a generally elliptical cover base 46 sealed against the outboard reflective surface of plate 42 by an O-ring or other suitable gasket 48 carried in a groove in cover base 46. Cover base 46 is molded of a suitable plastic such as that sold under the trademark "plexiglass" and includes a generally tubular portion 46*a* extending generally parallel to handle 10. Tubular portion 46*a* is of graduated length so as to provide for transition between its elliptical inboard end, adjacent plate 42, and its circular outboard end. Base 46 further includes a flange portion 46*b* radiating outwardly from the inboard end of portion 46*a* and abutting plate 42. Spaced circumferentially about flange 46*b* are a series of thickened lug members 46*c*, each of which threadedly receives the end of one of the screws 44**.

The outboard end of tubular portion **46*a* of base 46 is threadedly connected to a transparent cover 48, likewise molded of a suitable transparent material such as plastic. The end of cover 48 which is connected to tubular portion 46*a* of base 46 is open ended, and is sealed with respect to portion 46*a* by an O-ring 50 or the like. The opposite or outboard end of cover 48 is closed as shown. Cover 48, being transparent, does not interfere with the transmission of light from bulb 22 to the floor of a body of water, nor with the reflection of light from plate 42. However, cover 48 protects bulb 22 from breakage, contains the broken pieces of glass if the bulb is broken, and further insulates the bulb from the water so that it will not burst due to thermal shock. The two-piece construction comprising the base 46 and the cover proper 48 permits the latter to be easily removed to change the light bulb 22**.

The entire assemblage 40, 34, 42, 46 and 48 is firmly secured to handle section 12 in a particularly simple, inexpensive, yet highly effective manner via plates 40 and 42. More specifically, a tab or flap 52 is cut generally in the central area of plate 40 and folded away from the remainder of that plate, more specifically in the inboard direction, to leave an opening 54 for receipt of handle 12. Flap 52 is secured to handle section 12 by a conventional clamping ring 56 of any suitable type well known in the art. Similarly, a flap 58 is cut from the central area of plate 42 and folded outwardly to leave a hole 60 for receipt of handle section 12, and flap 58 is secured to handle section 12 by a clamping ring 62.

Numerous modifications may be made in the exemplary embodiment described hereinabove and shown in the drawings without departing from the spirit of the invention. For example, in some embodiments, the buoyant body 34 and at least some of the related parts might be swivelly mounted on handle 10. In other embodiments, the light source 22 and its protective cover 48 might be arranged perpendicular to body 34 and the attached plates 40 and 42, whereby it would be angularly disposed with respect to handle 10. Other exemplary modifications might involve changes in the means of mounting the various parts to one another, the means for adjusting the length of the handle, the configurations of various parts, etc. Accordingly, it is intended that the scope of the invention be limited only by the claims which follow.

I claim:

1. Subsurface lighting apparatus comprising:

illumination means;

an elongate handle attached to and extending from said illumination means, said handle comprising means for selectively adjusting the length of said handle; and flotation means comprising a buoyant body having inboard and outboard surfaces, said buoyant body being connected to said handle inboard of said illumination means and at a non-perpendicular angle with respect to said handle.

2. The apparatus of claim 1 further comprising a reflector plate secured against the outboard surface of said buoyant body.

3. The apparatus of claim 2 further comprising a transparent water-tight cover sealingly surrounding said illumination means.

4. The apparatus of claim 3 wherein said cover is removably attached to said buoyant body.

5. The apparatus of claim 1 wherein said means for adjusting the length of said handle is mechanical and manually operable and comprises means for selectively releasably fixing the length of said handle.

6. The apparatus of claim 2 wherein said reflector plate has an integral flap folded away from the remainder of said plate to form an opening receiving said handle, said flap being secured to said handle.

7. Subsurface lighting apparatus comprising:

illumination means;

an elongate handle attached to and extending from said illumination means;

a buoyant body having generally planar inboard and outboard surfaces connected to said handle inboard of said illumination means;

a reflector plate disposed against the outboard surface of said buoyant body;

a backing plate disposed against the inboard surface of said buoyant body; and means clamping said buoyant body between said backing plate and said reflector plate.

8. The apparatus of claim 7 wherein said buoyant body is disposed at a non-perpendicular angle with respect to said handle.

9. The apparatus of claim 7 further comprising a transparent water-tight cover sealingly surrounding said illumination means.

10. The apparatus of claim 9 wherein said cover is removably attached to said buoyant body.

11. The apparatus of claim 7 wherein at least one of said plates has an integral flap folded away from the remainder of said plate to form an opening receiving said handle, said flap being secured to said handle.

12. Subsurface lighting apparatus comprising:

illumination means;

an elongate handle attached to and extending from said illumination means;

plate means disposed inboard of said illumination means, said plate means having an integral flap folded away from the remainder of said plate means to form an opening receiving said handle, said flap being secured to said handle.

13. The apparatus of claim 12 wherein said plate means has a reflective outboard surface, said apparatus further comprising a buoyant body secured to said plate means inboard thereof.

* * * * *